US005703310A

United States Patent [19]

Kurakake et al.

[11] Patent Number: 5,703,310

[45] Date of Patent: Dec. 30, 1997

[54] AUTOMATIC PERFORMANCE DATA PROCESSING SYSTEM WITH JUDGING CPU OPERATION-CAPACITY

[75] Inventors: Yasushi Kurakake; Shigehiko Mizuno, both of Hamamatsu, Japan

[73] Assignee: Yamaha Corporation, Japan

[21] Appl. No.: 719,509

[22] Filed: Sep. 25, 1996

[30] Foreign Application Priority Data

Sep. 29, 1995 [JP] Japan ..... 7-253682

[51] Int. Cl.[6] ..... G10H 7/00; G04B 13/00; A61H 5/00

[52] U.S. Cl. ..... 84/609; 84/618; 84/626

[58] Field of Search ..... 84/600, 601, 609, 84/603, 626, 630, 661, 662, 618

[56] References Cited

U.S. PATENT DOCUMENTS 5,266,736 11/1993 Saito .
5,374,776 12/1994 Saito et al. .
5,554,814 9/1996 Nakata .
5,596,159 1/1997 O'Connell .

*Primary Examiner*—William M. Shoop, Jr.
*Assistant Examiner*—Jeffrey W. Donels
*Attorney, Agent, or Firm*—Graham & James LLP

[57] ABSTRACT

An automatic performance data processing system for reading automatic performance data from storage means at a predetermined period and supplying the automatic performance data to a musical sound generating system, the automatic performance data including event data representative of the contents of each performance event and time data representative of a time when the performance event occurs, the automatic performance data processing system including: a CPU for processing the automatic performance data; means for judging operation-capacity of the CPU; and a unit for determining an execution period of processing the automatic performance data in accordance with the judged CPU operation-capacity.

27 Claims, 11 Drawing Sheets

AUTOMATIC PERFORMANCE DATA PROCESSING SYSTEM WITH JUDGING CPU OPERATION-CAPACITY

BACKGROUND OF THE INVENTION

1. Field of the Invention

The present invention relates to generation of electronic musical tone signals, and more particularly to an automatic performance data processing system.

Musical tone signals are electronically generated by electronic musical instruments or synthesizers, or also by an arithmetic processing apparatus such as personal computers. The arithmetic processor unit of an arithmetic processing apparatus is hereinafter called a CPU, and a personal computer is illustratively used in the following description.

2. Description of the Related Art

A personal computer can perform various functions using software. Automatic performance or the like is known as one of software tasks of generating musical tone waveforms.

In the automatic performance process, event data of musical performance stored in a memory is read to generate control parameters for the generation of musical tone waveforms. Automatic performance data is generally a combination of event data and time data. The event data represents the contents of an event of musical performance, and the time data represents a time when the event occurs. The time data may be stored in various types such as an absolute time from the start of a program and a relative time between events.

A personal computer, particularly its CPU, has a limit in performance. If a process in excess of CPU performance is executed, a process delay occurs. For example, if a timer interrupt is executed at a speed over CPU performance, CPU cannot follow it. Even if a CPU has performance sufficient for automatic musical performance, the CPU performance may become insufficient if another task is executed at the same time when an automatic performance task is executed by multi-task processing (plural tasks are executed in parallel). The arithmetic processing over the CPU performance leads to musical tones poor in quality.

In multi-task processing, a priority order is generally set to each task. In such multi-task processing, if the priority order of an automatic musical performance task is lower than another task, this other task may intercept the automatic performance task. For example, if the load of a task other than the automatic performance task becomes large, automatic performance is gradually delayed. As a result, reading automatic performance data is delayed and the generated musical sounds are very poor in quality.

If the load of CPU for the automatic performance task is reduced in multi-task processing, execution of the automatic performance task can be prevented from being slowed. In this case, however, the high performance of CPU cannot be used efficiently and precise processing becomes impossible.

As above, if an automatic performance task has a load over CPU performance, execution of the task becomes likely to be delayed. If a plurality of tasks over CPU performance are executed at the same time, a task having a lower priority order becomes likely to be delayed. If a load of a task with a lower priority order is reduced, CPU performance cannot be efficiently used and fine processing becomes impossible.

SUMMARY OF THE INVENTION

An object of the present invention is to provide an automatic performance data processing system capable of efficiently using CPU performance by changing automatic performance task processing environments, and capable of preventing a delay of an automatic performance task even with a low priority order.

According to one aspect of the present invention, there is provided an automatic performance data processing system for reading automatic performance data from storage means at a predetermined period and supplying the automatic performance data to a musical sound generating system, the automatic performance data including event data representative of the contents of each performance event and time data representative of a time when the performance event occurs, the automatic performance data processing system comprising: a CPU for processing the automatic performance data; means for judging operation capacity of the CPU; and means for determining an execution period of processing the automatic performance data in accordance with the judged CPU operation-capacity.

According to another aspect of the present invention, there is provided an automatic performance data processing system for reading automatic performance data from storage means at a predetermined period and supplying the automatic performance data to a musical sound generating system, the automatic performance data including event data representative of the contents of each performance event and time data representative of a time when the performance event occurs, the automatic performance data processing system comprising: a CPU for being capable of processing an automatic performance data processing process and another process in parallel; designating means for designating an execution of the other process; and means for determining an execution period of processing the automatic performance data in accordance with whether the other process is executed or not.

The execution period of the automatic performance data processing is changed with the operation-capacity of a CPU. The automatic performance data processing is therefore possible efficiently using the CPU operation-capacity.

If another process different from the automatic performance data processing process is performed in parallel, the execution period of the automatic performance data processing is changed in accordance with whether the other process is executed. The automatic performance data processing is therefore possible efficiently using the CPU operation-capacity in accordance with the environment of the multi-task.

According to the present invention, the execution timing of the automatic performance is changed with the CPU performance and the amount of software processing. Therefore, the automatic performance can be performed properly in accordance with the processing conditions, and the CPU operation-capacity can be efficiently utilized.

DETAILED DESCRIPTION OF THE PREFERRED EMBODIMENTS

An automatic performance data processing system according to an embodiment of The invention will be described with reference to the accompanying drawings.

Figure 1A:
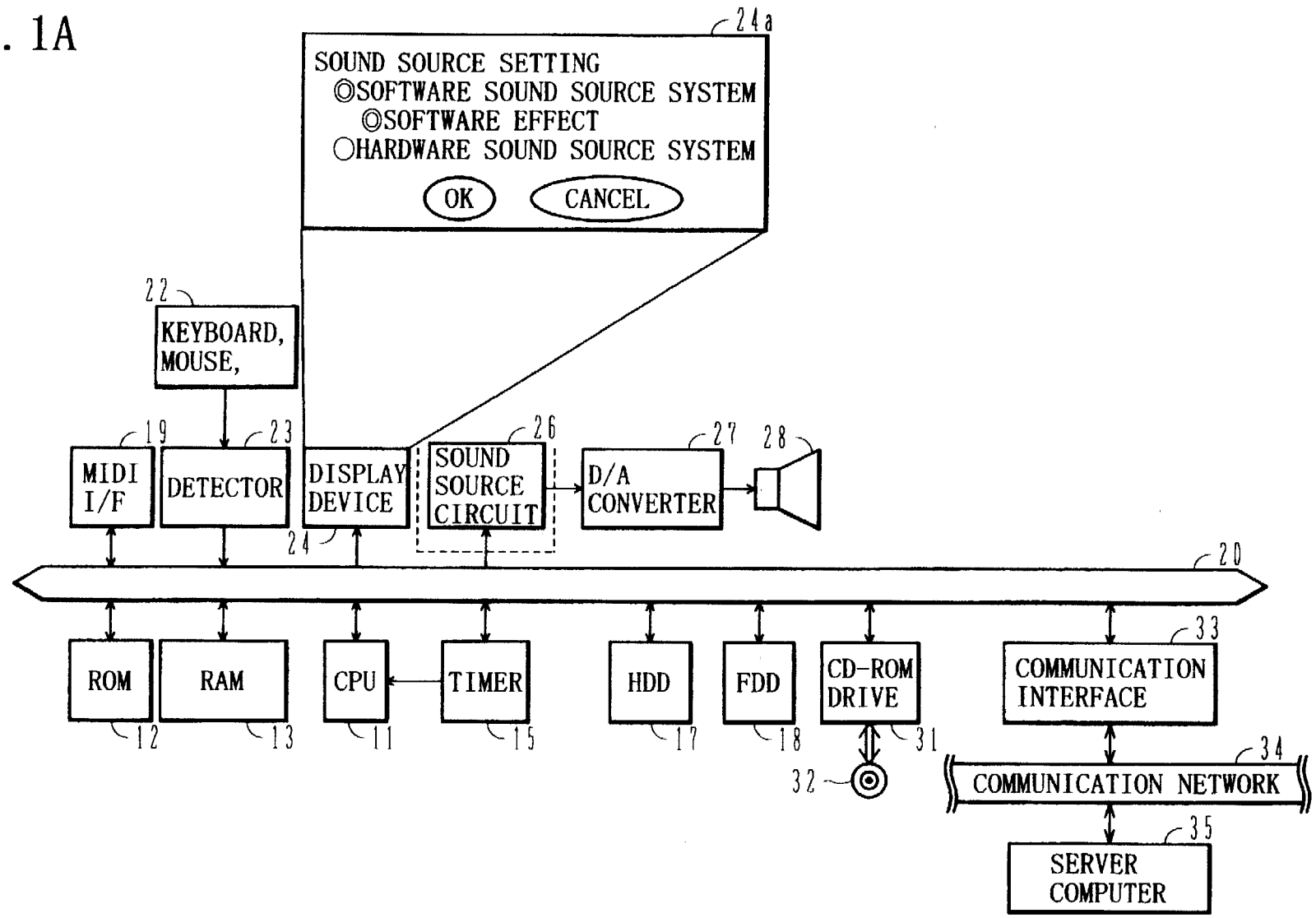
FIG. 1A is a block diagram showing an automatic performance system according to an embodiment of the invention.

FIG. 1A is a block diagram showing the structure of an automatic performance system according to an embodiment of the invention.

A CPU 11 performs arithmetic processing in accordance with programs stored in a ROM 12 or a RAM 13, by using RAM 13 as working registers. Automatic performance is executed by moving an automatic performance program stored in a hard disk drive (HDD) 17 to RAM 13 and reading automatic performance data in a floppy disk drive (FDD) 18 or HDD 17.

A timer 15 supplies a timing signal to CPU 11. A MIDI interface 19 Transfers signals to and from an external system. Automatic performance data may be supplied via the MIDI interface 19. An input from an input means 22 such as a keyboard and a mouse is detected by a detector 23 and coupled to a bus 20 which connects CPU 11, ROM 12, RAM 18, timer 15, HDD 17, FDD 18, a display device 24, and other elements.

The display device 24 connected to the bus 20 displays information supplied from CPU 11 on its display screen 24*a*. In an example shown in FIG. 1A, a sound source setting screen is displayed on the display screen 24*a*. By this sound source setting screen, a software sound source system (generating musical tone waveforms through computation by CPU) or a hardware sound source system (generating musical tone waveforms by dedicated hardware) is selected. In this example, the software sound source system and a software effect (giving sound effects such as reverb to musical tone waveforms through computation by CPU) are selected and displayed as an initial state.

While a software sound source system is pointed by flushing or coloring, if a cursor is moved to "OK" and the mouse is clicked, the software sound source system is selected. If the cursor is moved to "CANCEL" and the mouse is clicked, the selected software sound source system is cancelled.

After the software sound source system is selected, the software effect is pointed by flushing or coloring. If the cursor is moved to "OK" and the mouse is clicked, the software effect is selected. If the cursor is moved to "CANCEL" and the mouse is clicked, the selected software effect is cancelled. If the software sound source system is not selected, the hardware sound source system is displayed and pointed. While the hardware sound source system is pointed, if the cursor is moved to "OK" and the mouse is clicked, the hardware sound source system is selected. If the hardware sound source system is also cancelled after the software sound source system was cancelled, the MIDI interface is selected.

A sound source circuit 26 constitutes a hardware sound source system made of a sound source board or the like and can be connected to or disconnected from the bus 20. A digital-analog (D/A) converter 27 receives digital musical tone signal waveforms from the sound source circuit 26 or bus 20 and converts them into analog signals and supplies the analog signals to a sound system 28 which generates audible sounds.

If the software sound source system is selected, CPU 11 generates musical tone signal waveforms in accordance with the software sound source program and musical tone control parameters read from ROM 12 or RAM 13 (software sound source system task). If the hardware sound source system is selected, the sound source circuit 26 generates musical tone signal waveforms in accordance with musical tone control parameters read from ROM 12 or RAM 13.

If the software effect is also selected after the software sound source system was selected, CPU 11 generates musical tone signal waveforms in accordance with musical tone control parameters read from ROM 12 or RAM 13, and thereafter performs the effect adding process and stores the musical tone signal waveforms added with the musical effect are stored in RAM 13 (software effect task). In the case of the software sound source system, the musical tone signal waveforms generated by CPU 11 are temporarily stored in RAM 13 and then read and supplied directly to the D/A converter 27 to generate sounds from the sound system 28.

If the hardware sound source system is used, the number of tasks to be executed by CPU 11 is small. If the software sound source system and software effect are used, the number of tasks to be executed by CPU 11 is large because CPU 11 is required to generate musical tone signal waveforms.

For the automatic musical performance, CPU 11 reads automatic performance data stored in HDD 17 or FDD 18 and temporarily stores the read data in RAM 13, and thereafter generates musical tone signal waveforms (automatic performance task).

Figure 1B:
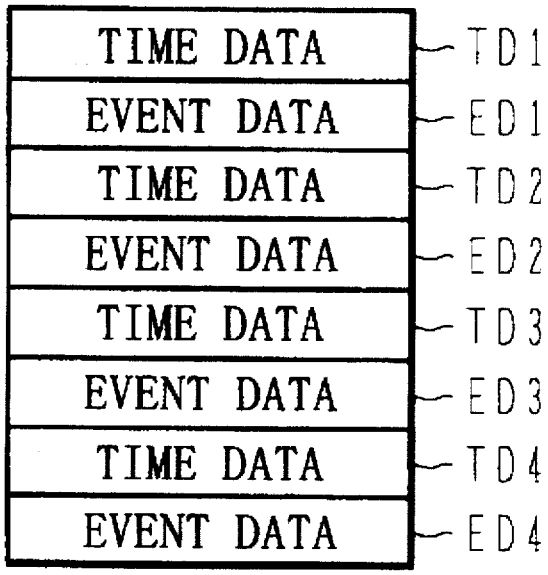
FIG. 1B is a schematic diagram showing the format of automatic performance data.

FIG. 1B shows an example of automatic performance data. The unit of automatic performance data is a pair of time data TD and event data ED. The time data TD defines a time when the corresponding event data is generated. For example, the time data indicates a time duration from the preceding event to the next event.

The event data ED is constituted by information such as a note-on, a note-off, and a key code. In the example shown in FIG. 1B, four pairs of automatic performance data are shown. The first time data TD1 indicates a time when the first event is generated, and has no positive meaning. The time data is generally represented by the number of clocks each corresponding to a predetermined note length (e.g., a length of one 384th note).

The automatic performance software is stored in HDD 17. The same software is executed by CPUs having different performances. If CPU 11 has a high performance, even a short interrupt period for automatic performance data processing can be processed. If CPU 11 has a low performance, it is preferable to lengthen the timer interrupt period for automatic performance data processing.

If the software sound source system is used during automatic performance, the load of CPU becomes large because of the software sound source processing. If the same automatic performance processing is executed for both with and without the software sound source system, the performance of CPU 11 and the amount of tasks to be executed become unbalanced.

HDD 17 is a storage unit for storing various data such as computer programs and automatic performance data. If computer programs are not stored in ROM 12, computer programs are stored in a hard disk of HDD 17 and written in RAM 13 to run CPU 11. In this manner, addition, version-up, and the like of computer programs become easy. A CD-ROM (compact disk read-only memory) drive 31 reads the computer programs and various data stored in a compact disk 32. The computer programs and various data are stored in a hard disk of HDD 17, facilitating new installation and version-up of computer programs. Other drives may also be installed to use other external storage media such as a magnetooptical disk.

A communication interface 33 is connected to a communication network 34 such as a LAN (local area network), Internet, and telephone lines, and via the communication network 34 to a server computer 35. If computer programs and various data are not stored in HDD 17, they are down loaded from the server computer 35. The automatic performance system of this embodiment as a client transmits a command requesting for downloading computer programs and data to the server computer 35 via the communication interface 33 and communication network 34. Upon reception of this command, the server computer 35 supplies the requested computer programs and data to the automatic performance system via the communication network 34 and communication interface 33, and the automatic performance system stores the received programs and data in HDD 17 to complete the down-load.

The embodiment may be practiced by commercial personal computers or the like by loading therein the computer programs and various data of this embodiment. The computer programs and various data of the embodiment may be supplied to users in the form of storage media such as a compact disk and a floppy disk readable by a personal computer. If a personal computer is used connected to a communication network such as LAN, Internet, and telephone lines, the computer programs and various data may be supplied thereto via the communication network.

Figure 2:
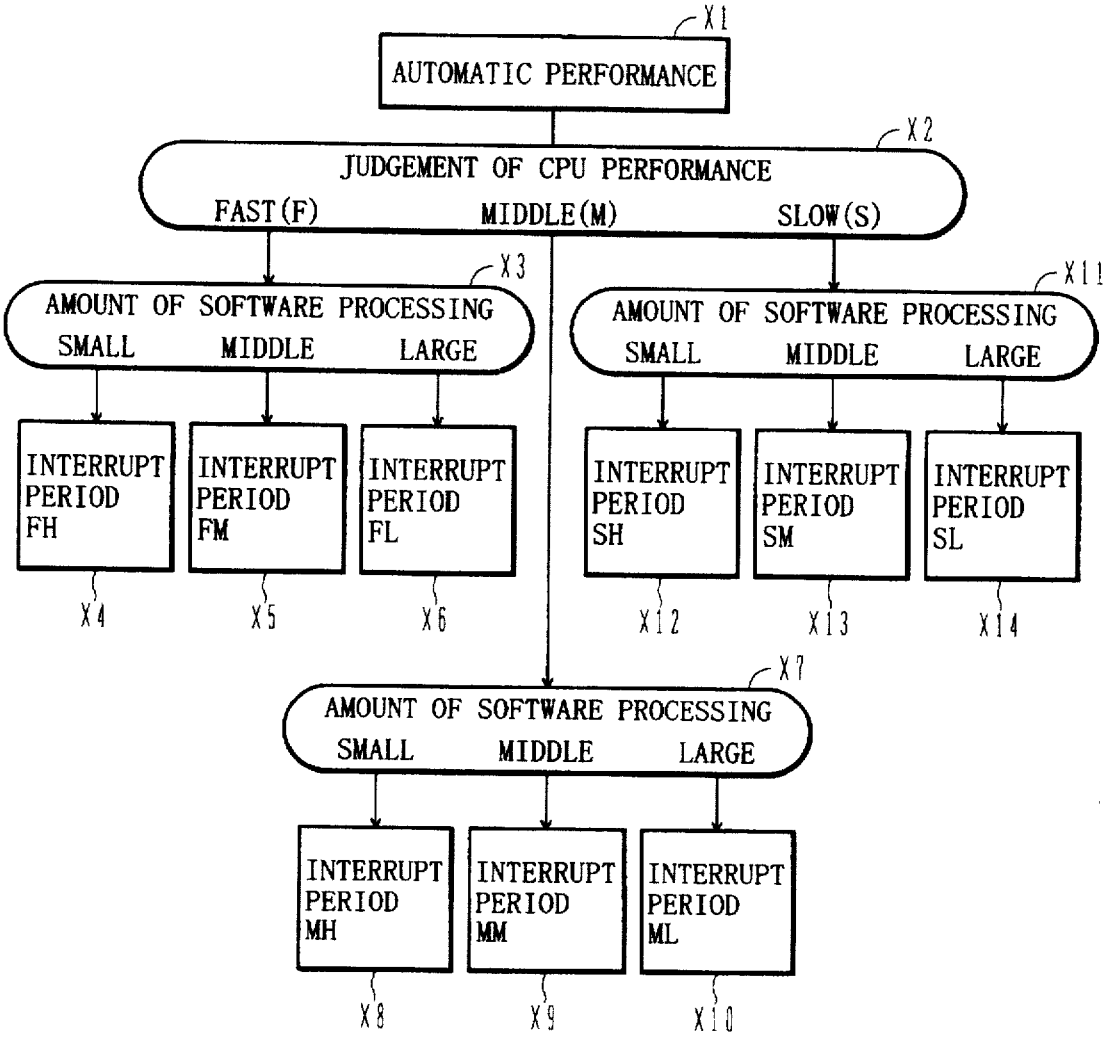
FIG. 2 is a diagram illustrating a method of determining an automatic performance interrupt period.

FIG. 2 illustrates a method of determining an automatic performance interrupt period. First, at a stage X1, the automatic performance is selected. At the next stage X2, the performance (operation-capacity) of CPU is judged. The performance of CPU is classified into three groups, fast, middle, and slow. If the performance of CPU is judged to be fast, the amount of software processing is judged at a stage X3. If the automatic performance task only is to be executed, it is judged that the amount of software processing is small. If the software sound source system is used during the automatic performance, the amount of software processing is judged to be middle. If the software sound source system is used together with the software effect, the amount of software processing is judged to be large.

If the amount of software processing is small, the interrupt period is set to a shortest period HF at a stage X4 because the performance of CPU is fast. If the amount of software processing is middle, the interrupt period is set to FM at a stage X5. If the amount of software processing is large, the interrupt period is set to FL at a stage X6. The relationship between these periods is FH<FM<FL.

Similarly, if the performance of CPU is middle, the amount of software processing is judged at a stage X7. In accordance with the amounts of software processing, small, middle, and large, the interrupt periods are respectively set to MH, MM, ML at stages X8, X9, and X10. If the performance of CPU is slow, the amount of software processing is judged at a stage X11. In accordance with the amounts of software processing, small, middle, and large, the interrupt periods are respectively set to SH, SM, SL at stages X12, X13, and X14.

The interrupt period with H is shorter than the interrupt period with M, and the interrupt period with M is shorter than the interrupt period with L. Namely, $$FH<FM<FL$$

$$MH<MM<ML$$

$$SH<SM<SL$$

The set interrupt periods may be in duplicate or overlapped for CPUs with different performances. For example, the interrupt period for CPU having a high performance and a large amount of software processing may be set equal to or longer than the interrupt period for CPU having a low performance and a small amount of software processing, such as FL=MH and FL=MM.

In the example shown in FIG. 2, the automatic performance interrupt period is determined depending upon the CPU performance and the amount of software processing. This interrupt period may be determined depending upon either the CPU performance or the amount of software processing.

The more specific operation of the automatic performance system of this embodiment shown in FIG. 1A will be described.

Figure 3:
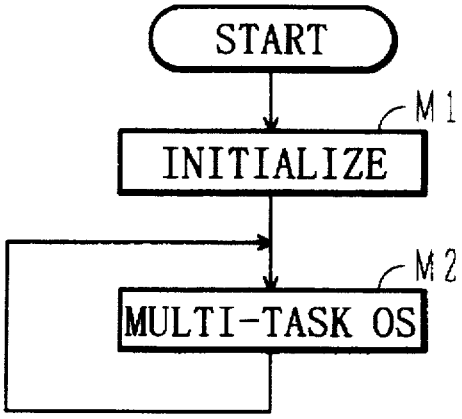
FIG. 3 is a flow chart illustrating a main flow.

FIG. 3 is a flow chart illustrating the main flow of the automatic performance system. The system power is turned on to start the automatic performance task. The system is initialized at step M1. For example, the software sound source system is made on and the software effect is made on. The software sound source system and the software effect are automatically selected. At next step M2, a multi-task OS (operating system) manages the execution of multi-task.

Figure 4:
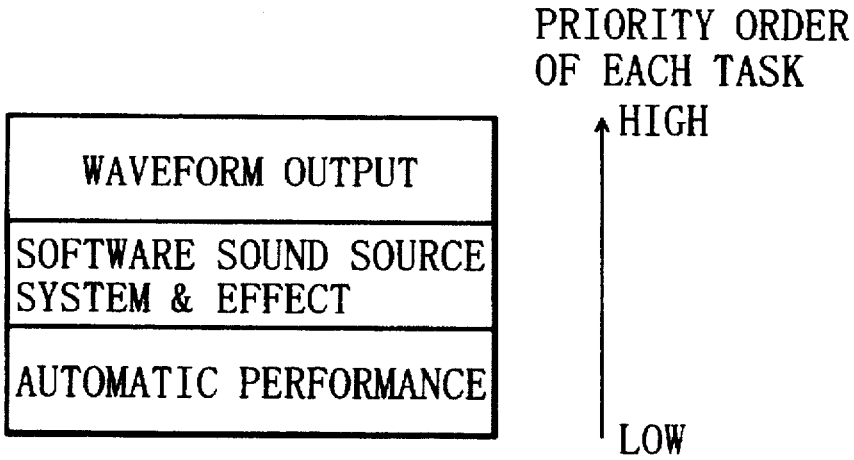
FIG. 4 is a diagram illustrating an example of multi tasks.

FIG. 4 shows an example of multi-task. The first task is a waveform output task which is generated by the software sound source system task and time sequentially outputs musical tone signal waveforms stored in RAM 13. The next task is a software sound source system task and a software effect task which generate waveform signals in accordance with musical tone control parameters and store them in RAM 13.

Both the software sound source system task and effect task may be selected or only one of them may be selected. For the simplicity of description, it is assumed in the following that the effect task can be selected only when the software sound source system task is selected.

The last automatic performance task reads the automatic performance data stored in the memory and stores it in another memory. As shown in FIG. 4, the priority order of each task is higher than that of a lower task shown in FIG. 4.

The software sound source system task and effect task are executed at a timer interrupt of, for example, 5 msec, and the automatic performance task is executed at a timer interrupt of, for example, 5 to 20 msec. The waveform output task is executed more often than the other two tasks.

Figure 5:
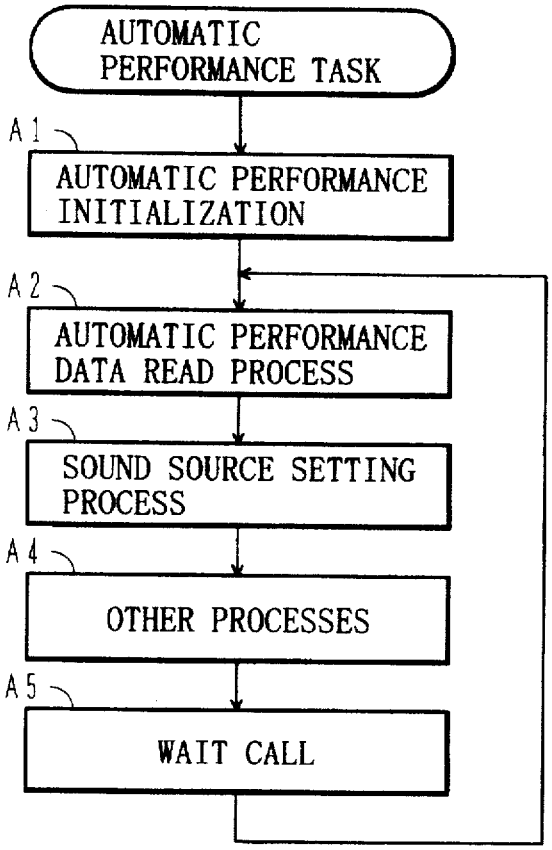
FIG. 5 is a flow chart illustrating the operation by an automatic performance task.

FIG. 5 is a flow chart illustrating the operation of the automatic performance task. As the automatic performance program is activated and the automatic performance task starts, first the automatic performance is initialized.

Figure 6A:
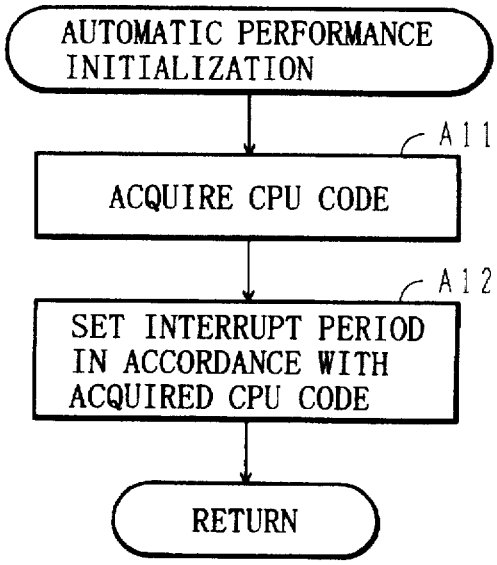
FIGS. 6A and 6B are flow charts illustrating the operation of automatic performance initialization.
Figure 6B:
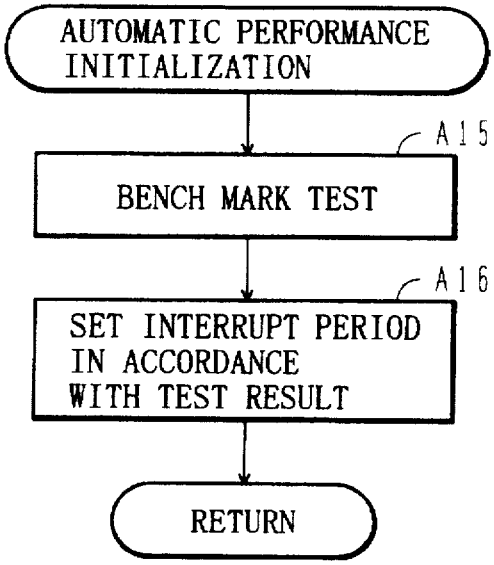

FIGS. 6A and 6B show two examples of the automatic performance initialization. In the first example shown in FIG. 6A, as the automatic performance initialization starts, a CPU code is acquired at step A11. This CPU code acquisition may be automatically performed by a program, or a user may input it by using the display screen shown in FIG. 1A.

At next step A12, in accordance with the acquired CPU code, a first interrupt period is set. The first interrupt period is a period which may be modified at the later process. Thereafter, the process returns to the initial state.

In the second example of the automatic performance initialization shown in FIG. 6B, as the automatic performance initialization starts, a bench mark test is performed at step A15 to obtain the bench mark test results representative of the CPU performance.

At next step A16, in accordance with the test results, the first interrupt period is set. Thereafter, the process returns to the initial state. In the above two examples, the first interrupt period is set, for example, to FH (5 msec) for fast CPU, to MH (10 msec) for middle CPU, and to SH (20 msec) for slow CPU. Specifically, the first interrupt period is classified into three groups F, M, and S in accordance with the CPU performance and the amount of software processing for each group, and the first interrupt period is temporality set to the small amount of software processing, i.e., (H). The first interrupt period is modified in accordance with the amount of software processing as will be described with FIG. 9.

Returning back to FIG. 5, after step A1, an automatic performance data read process is performed at next step A2.

Figure 7:
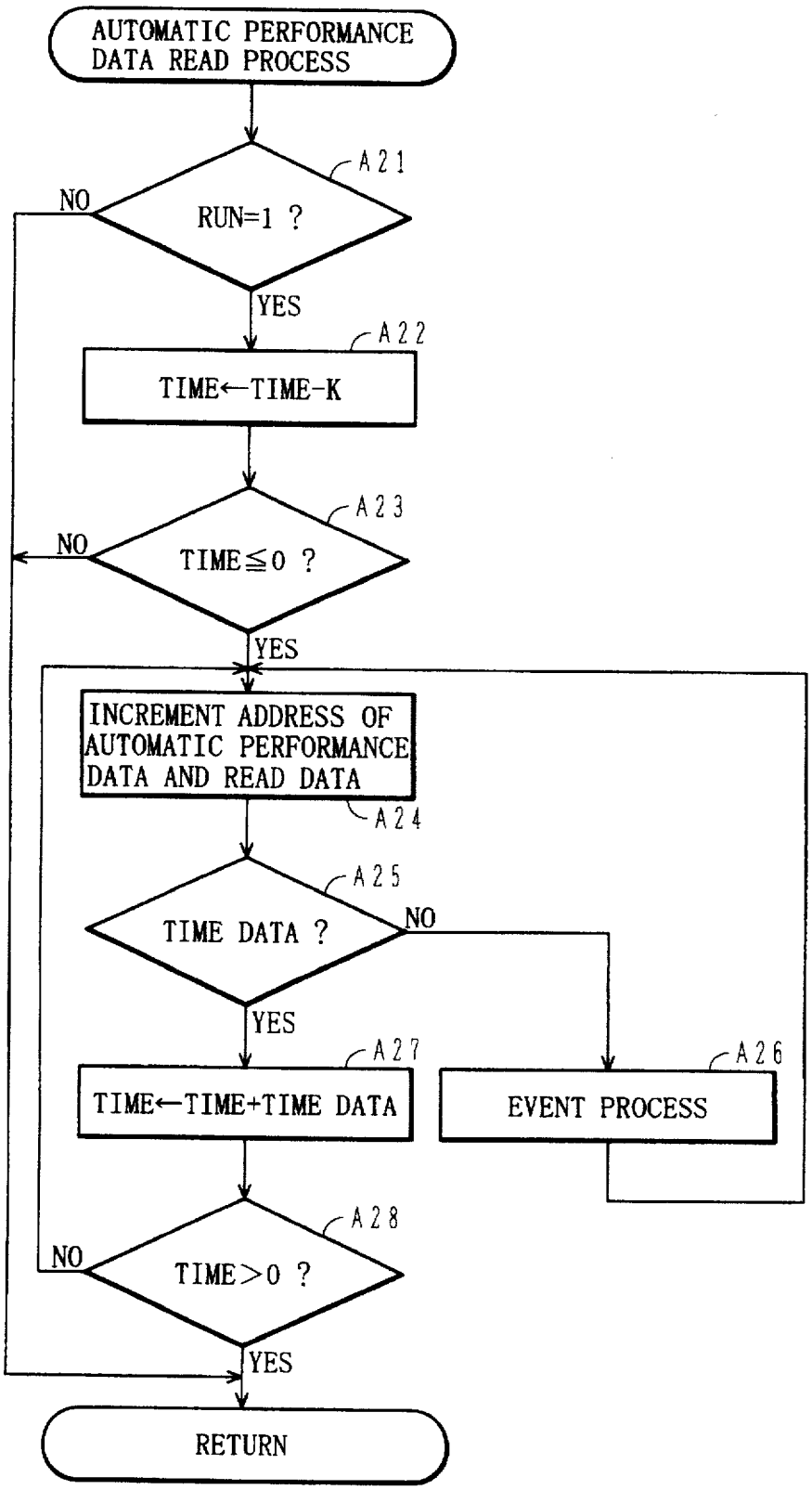
FIG. 7 is a flow chart illustrating the operation of an automatic performance data read process.

FIG. 7 is a flow chart illustrating an example of the automatic performance data read process. As this process starts, it is checked at step A21 whether or not a flag RUN for the automatic performance data read process is "1". If the flag RUN is "1", it means that the automatic performance data read process has been set. In this case, the flow advances to step A22 following the YES arrow whereat a constant value K is subtracted from a value in a register TIME, and the results are again set to the register TIME. The register TIME stores as its initial value, for example, K. Each time an interrupt of the automatic performance data read process occurs, the value in the register TIME is reduced by K.

This constant K is determined in accordance with an interrupt period for the automatic performance data read process. For example, the value K is represented by:

$$K=(\text{tempo}\times\text{resolution}\times\text{interrupt period})/(60\times1000)$$

When a time is represented by msec, one minute is 60×1000 msec. The tempo shows the number of quarter notes performed during one minute. The resolution is a resolution of a quarter note. Therefore, the tempo x resolution indicates the number of shortest time units per minute: The interrupt period is a timer interrupt period (msec). Therefore, the constant K is an inverse of the number of interrupts during the shortest time unit for sound processing.

For example, assuming that the performance tempo is 120, the resolution is 96, and the interrupt interval is 10 ms, $$K=(120\times96\times10)/(60\times1000)=1.92.$$

Similarly, if the tempo is 180, $$K=(180\times96\times10)/(60\times1000)=2.88.$$

If the performance tempo is 120, the resolution is 96, and the interrupt interval is 20 ms, $$K=(120\times96\times20)/(60\times1000)=3.84$$

As the tempo becomes fast or the interrupt period becomes long, the value K becomes large so that the value in the register TIME is reduced more at each interrupt.

The register TIME has a time taken for the next event to occur. Therefore, if the value K is large, the next event occurs after a small number of interrupts, whereas if the value K is small, the next event occurs after a large number of interrupts. Since the next event occurs at a predetermined timing, the interrupt period is made short if the value K is small and long if the value K is large.

At next step A23 it is checked whether or not the register TIME is "0" or smaller. In the above example, the value K is subtracted from the TIME initial value (which is the first time data in the performance data set during the performance start process not shown). If the TIME is "0" or negative, it means the timing when the next event is read. Therefore, the flow advances to next step A24 following the YES arrow whereat the address of the automatic performance data is incremented to read the data.

At next step A25, it is checked whether or not the read data is time data. As shown in FIG. 1B, the automatic performance data is a pair of time data and event data. If the first data is the time data, the judgement at step A25 is YES and the flow advances to step A27 whereat TIME is updated. At next step A28 it is checked whether or not the register TIME is larger than "0" If not, i.e., if the register TIME is equal to or smaller than "0", the judgement at step A28 is NO and the flow returns to step A24.

When the address is incremented and the data is read at step A24, the read data is event data. Therefore, the judgement at step A25 is NO and the flow advances to step A26 following the NO arrow to perform an event process. In this case, if the software sound source system is selected, the read event (note-on/note-off and key code) is written in a register of the software sound source system. If the software sound source system is a multi-channel system (having a plurality of musical tone signal waveform generating channels allowing to generate a plurality of sounds at the same time), a channel assign process is also performed.

After step A26, the flow returns to step A24 to read the time data at an incremented address. This time data indicates a time taken for the next event to occur. The judgement at step A25 is YES and the flow advances to step A27. At step A27, the read time data is added to the value in the register TIME to update the register TIME. At next step A28 it is judged whether the value in the updated register TIME is positive or not. If positive, the flow returns to the initial state following the YES arrow. If the flag RUN is "0" at step A21, the flow immediately returns to the initial state following the NO arrow. If the value in the register TIME at step A23 is not "0" nor negative, the flow immediately returns to the initial state because it is not still at the timing when the next automatic performance data is read.

Thereafter, the value in the register TIME is subtracted by K at each interrupt. If the value in the register TIME becomes "0" or negative, the next event is read. If the value in the register TIME is not positive even if it is updated, it means that it is already at the timing when the next data is read so that the flow returns to step A24 whereat the event data and time data are read. In the above manner, the automatic performance data is read until the value in the register TIME becomes positive. When the value in the register TIME becomes positive, the judgement at step A28 changes to YES and the flow returns to the initial state. Namely, if the reduced value K is larger than the read time data value, a plurality of event data are read.

As above, by setting the first interrupt period in accordance with the CPU performance judged at step A1 shown in FIG. 5 and by setting the constant K in accordance with the interrupt period, the automatic performance data read process can be executed at the interrupt period matching the CPU performance.

Returning back to FIG. 5, after the automatic performance data read process is completed at step A2, a sound source setting process is executed at step A3.

Figure 8:
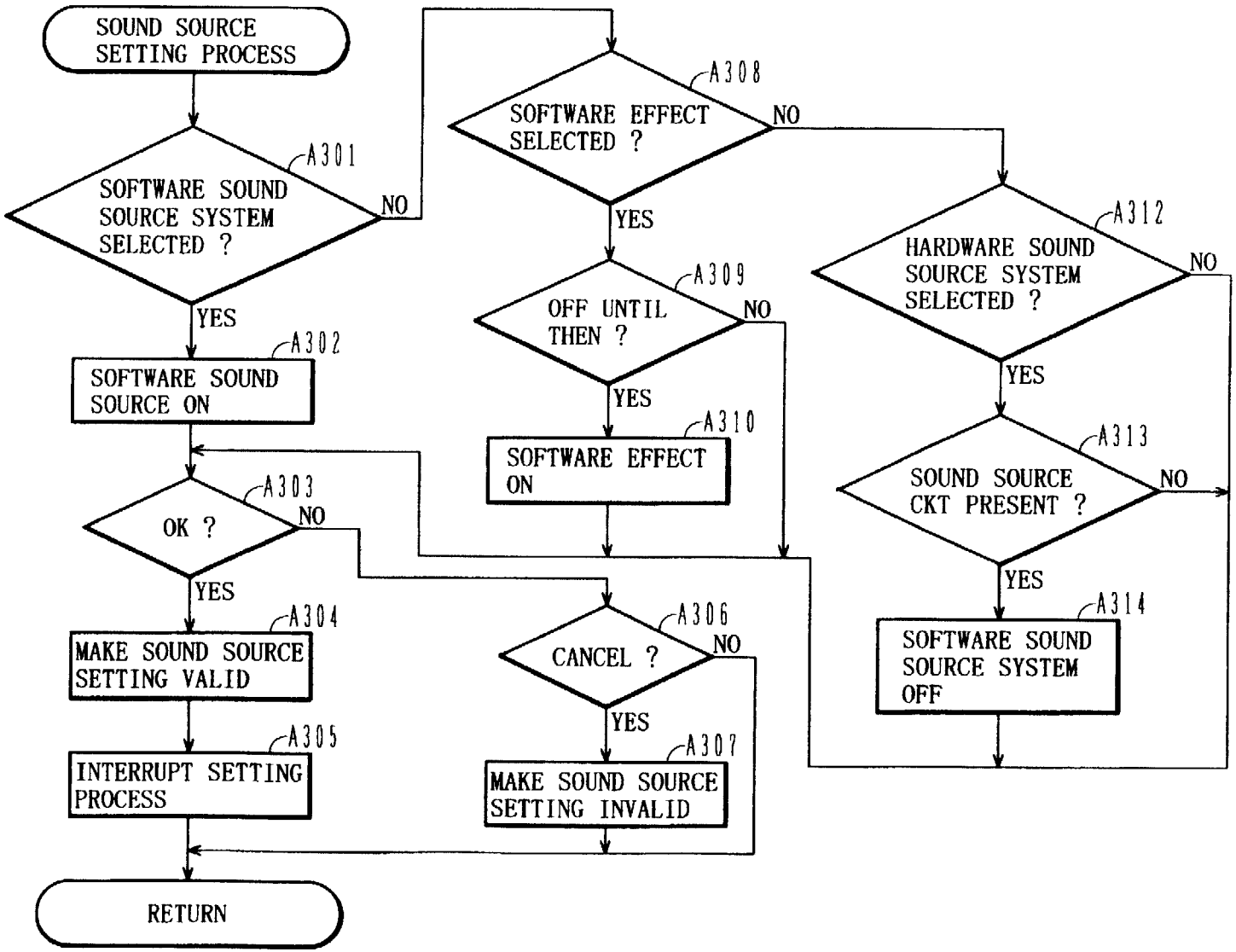
FIG. 8 is a flow chart illustrating the operation of a sound source setting process.

FIG. 8 is a flow chart illustrating an example of the operation by the sound source setting process. As this process starts, it is checked at step A301 whether the software sound source system is selected, i.e., whether the "software sound source system" is clicked or not. If the software sound source system is selected, the flow advances to step A302 following the YES arrow whereat the display of the software sound source system is turned on on the display screen 24*a* shown in FIG. 1A. For example, doubled circles are displayed on the display screen 24*a*. Next, it is checked at step A303 whether "OK" is clicked or not. If clicked, the flow advances to step A304 following the YES arrow whereat the setting of the software sound source system is made valid. At next step A305, the interrupt setting process is executed which will be later detailed.

If the software sound source system is not selected at step A301, the flow advances to step A308 following the NO arrow whereat it is checked whether the software effect is selected, i.e., whether the "software effect" is clicked. If selected, the flow advances to step A309 whereat it is checked whether the software effect has been off until then. If on, the flow immediately advances to step A303 because the software effect on the display screen has been already made on. If off, the flow advances to step A310 whereat the software effect on the display screen is made on. For example, doubled circles are displayed on the display screen 24*a* shown in FIG. 1A. Thereafter, at step A303 or A306 it is judged whether "OK" or "CANCEL" on the display screen is clicked or not, and in accordance with this judgement the setting of the software effect is made invalid or valid at step A304 or A307. If the software effect is made valid, the interrupt setting process is further executed at step A305.

If the software effect is not selected at step A308, the flow advances to step A312 whereat it is checked whether the hardware sound source system is selected, i.e., whether the "hardware sound source system" is clicked. If the hardware sound source system is selected, the flow advances to step A313 following the YES arrow whereat it is checked whether the sound source circuit is being loaded. If the sound source circuit is being loaded, the flow advances to step A314 following the YES arrow whereat the software sound source system is turned off. Thereafter the flow advances to step A303 to execute similar processes described above.

If the hardware sound source system is not selected at step A312 or if the sound source circuit is not being loaded at step A313, the flow advances immediately to step A303 following the NO arrow. The state that both the hardware and software sound source systems are not selected means that the MIDI sound source is connected.

The sound source setting process shown in FIG. 8 is executed even during the automatic performance when the sound source setting is changed on the display screen 24*a* shown in FIG. 1A.

Figure 9:
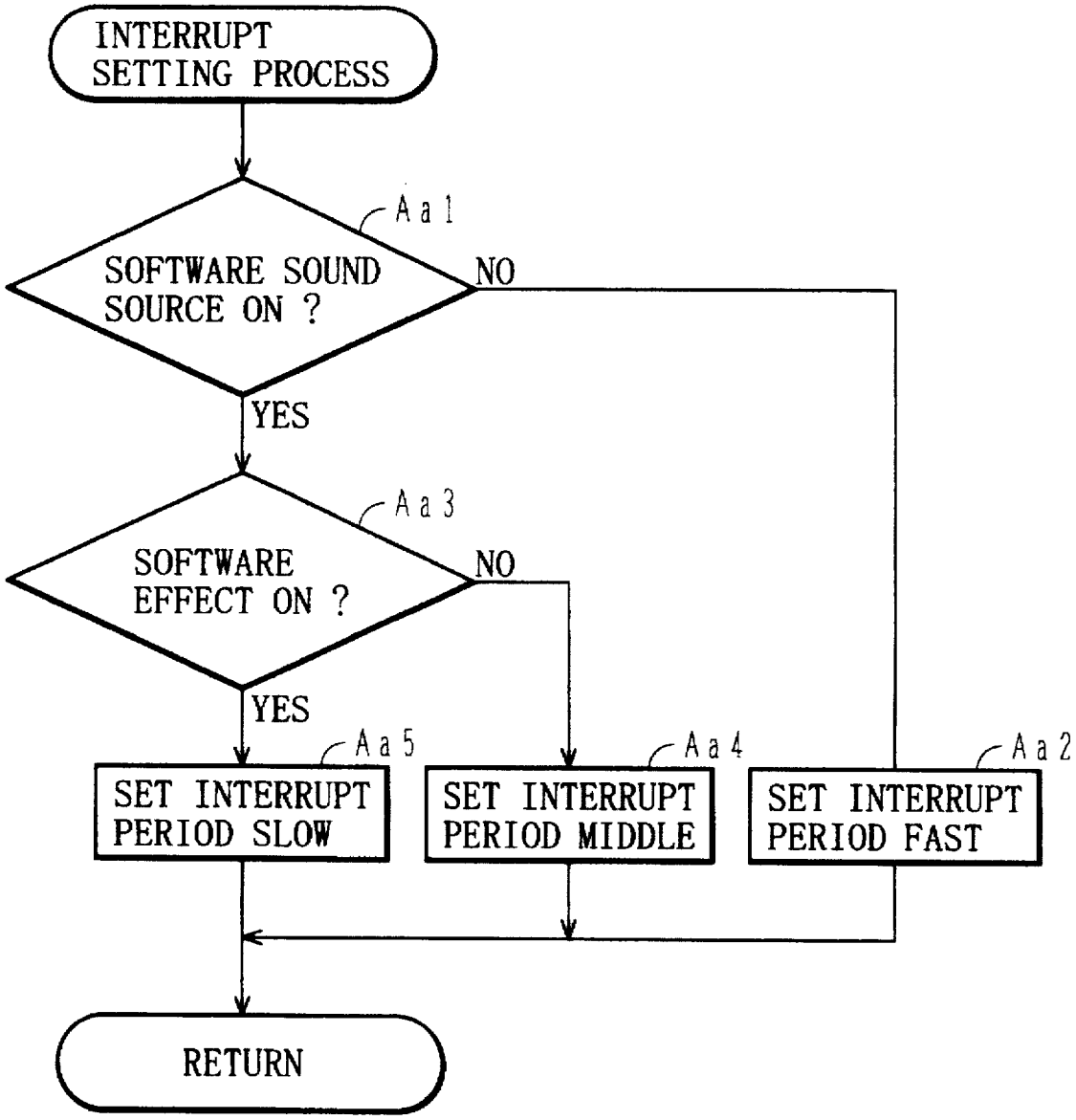
FIG. 9 is a flow chart illustrating the operation of an interrupt setting process.

FIG. 9 is a flow chart illustrating an example of the operation by the interrupt setting process. As this process starts, it is checked at step Aa1 whether the software sound source system is on. If not, the flow advances to step Aa2 following the NO arrow whereat the interrupt period is set to be fast.

If the software sound source system is set at step Aa1, the flow advances to step Aa3 following the YES arrow whereat it is checked whether the software effect is set. If not, the flow advances to step Aa4 following the NO arrow whereat the interrupt period is set to be middle.

If the software effect is set at step Aa3, the flow advances to step Aa5 following the YES arrow whereat the interrupt period is set to be low. In the above manner, the first interrupt period set in accordance with the CPU performance at stage X1 shown in FIG. 2 is modified at steps Aa2, Aa4, and Aa5 to be fast, middle, and low. For example, if the CPU performance is high, the interrupt period is set to FH (5 msec) for fast, to FM (10 msec) for middle, and to FL (20 msec) for low. Similarly, if the CPU performance is middle, the interrupt period is set to MH, MM, and ML, and if the CPU performance is low, it is set to SH, SM, and SL. The flow thereafter returns to the initial state.

As above, the interrupt period is first classified in accordance with the CPU performance, and then it is modified in accordance with the setting state of the software sound source system and software effect.

Returning back to FIG. 5, the other steps of the automatic performance task will be described. The other processes are performed at step A4 after the execution of steps A1, A2, and A3 described above. After the other processes are completed, the flow advances to step A5 whereat the multi-task OS enters a wait state upon reception of a wait call. Namely, the automatic performance task is intercepted until the next interrupt occurs.

Figure 10A:
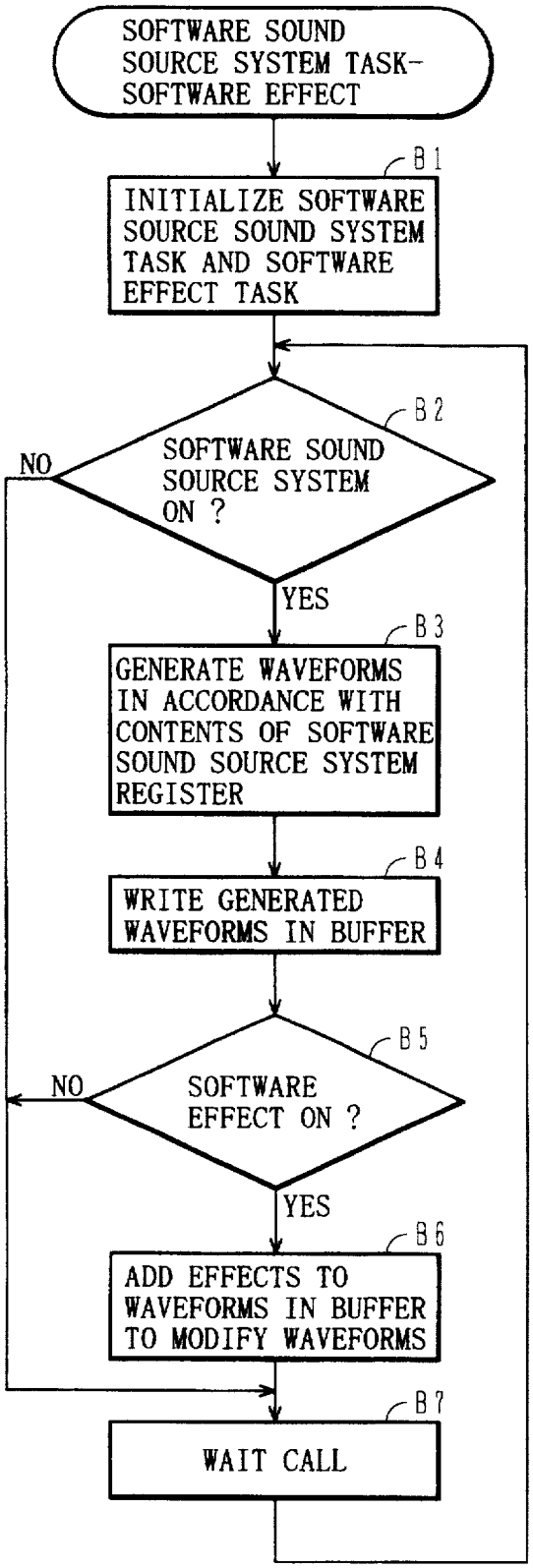
FIGS. 10A and 10B are flow charts illustrating the operation by other tasks.
Figure 10B:
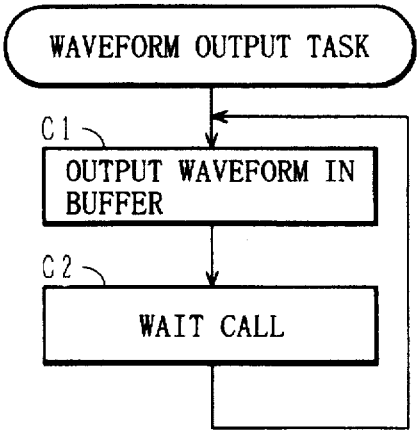

FIGS. 10A and 10B are flow charts illustrating examples of the operation by tasks other than the automatic performance task. FIG. 10A illustrates an example of the software sound source system task and software effect task which start upon selection thereof. As this process starts, the software sound source system and software effect are initialized at step B1.

Next, it is checked at step B2 whether the software sound source system is on. If on, the flow advances to step B3 following the YES arrow whereat musical tone waveforms are generated in accordance with the contents (note-on/note-off, key code) of the software sound source system register. If a multi-channel sound source system is used, musical tone waveforms are generated in accordance with the contents of the multi-channel sound source system register at each channel. Musical tone waveforms are generated through pulse code modulation (PCM), frequency modulation (FM), or the like.

After waveforms up to the next process timing (=5 msec) are generated, the flow advances to step B4 whereat the generated waveforms are written in the buffer. Thereafter, at step B5 it is checked whether the software effect is set.

If set, the flow advances to step B6 following the YES arrow whereat musical effects are added to the waveforms stored in the buffer and the results are stored in the buffer. Musical effect addition may be a reverb process, a chorus process, and the like. Thereafter, at step B7 the multi-task OS enters a wait state upon reception of a wait call. At step B2 or B5, if the judgment is negative, the flow immediately advances to step B7 following the NO arrow.

FIG. 10B is a flow chart illustrating the operation by the waveform output task. As this process starts, the musical tone waveforms written in the buffer are output to the D/A converter 27 at step C1. Thereafter, at step C2 the multi-task OS enters the wait state upon reception of the wait call.

The waveform output task sequentially reads musical tone waveforms changing with time, and is most frequently performed (e.g., at 44.1 kHz=0.0226 msec).

Figure 11A:
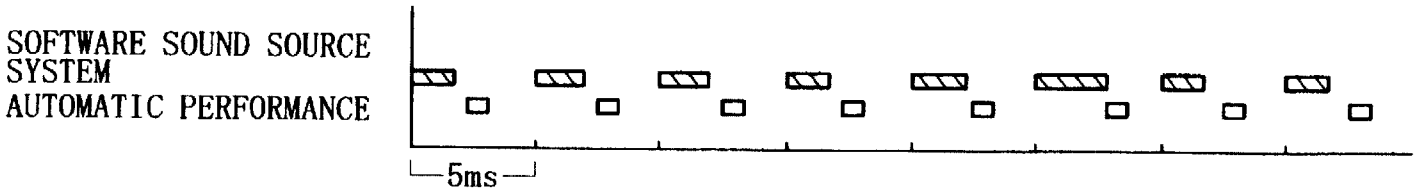
FIGS. 11A and 11B are schematic diagrams showing examples of the automatic performance interrupt period for CPUs with different performances.
Figure 11B:
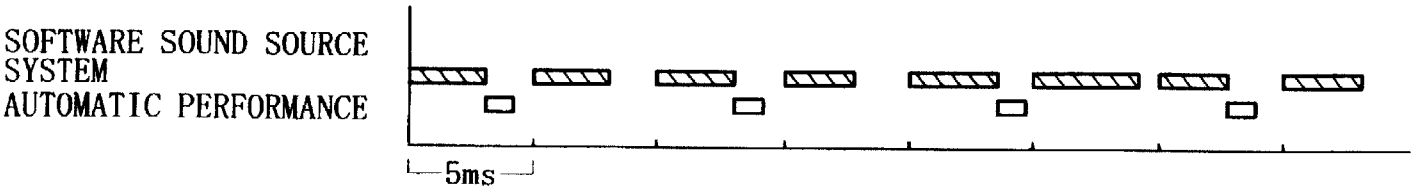

FIGS. 11A and 11B are diagram illustrating how tasks are executed at the interrupt period of the automatic performance. The abscissa represents time, a blank frame indicates the time during the automatic performance, and a hatched frame indicates the time during the software sound source system process. FIG. 11A stands for the interrupt process with a fast CPU. Since the CPU performance is sufficient, the software sound source system process and the automatic performance process are executed each unit time of the processes. FIG. 11B stands for the interrupt process of the automatic performance with a slow CPU. The automatic performance process is executed once each time the software sound source system process is performed twice.

With the slow CPU, after the software sound source system process is performed twice, the automatic performance process is performed once. Since the interrupt period of the automatic performance is long, the amount of software processing of the automatic performance is reduced so that the automatic performance process is suppressed from being delayed by the software sound source system process. By making the interrupt period of the automatic performance long, musical tones to be sequentially generated may be generated in a burst manner. However, a listener can feel better rather than the musical tones are delayed.

Figures 12A, 12B, 12C:
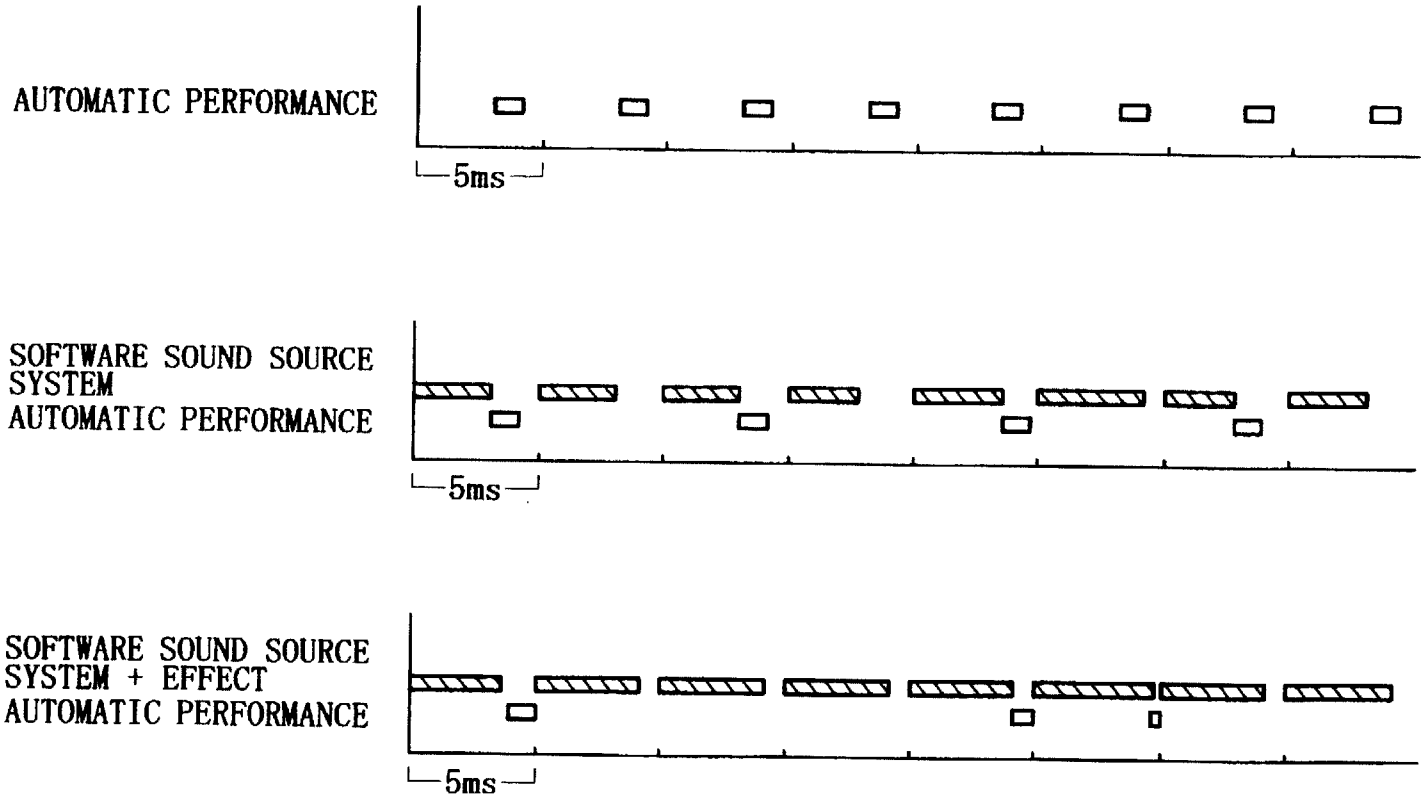
FIGS. 12A to 12C are schematic diagrams showing examples of the automatic performance interrupt period for the different amounts of software processing.

FIGS. 12A to 12C illustrate examples of a change in the interrupt timing of the automatic performance, with the amount of software processing. FIG. 12A stands for the automatic performance process only. The automatic performance is performed once per each unit period.

FIG. 12B stands for both the automatic performance process and the software sound source system process. The software sound source system process is performed with a priority over the automatic performance process. If the automatic performance process is performed once per each unit period similar to the case of FIG. 12A, a delay of the automatic performance process may be generated because of the increased amount of software processing. From this reason, the number of automatic performance processes is reduced to one per two software sound source system processes. Since the number of automatic performance processes is reduced, the amount of software processing is reduced and so a delay of the automatic performance is reduced.

FIG. 12C stands for the software effect process added to the software sound source system process with the automatic performance process. Since both the software effect process and the software sound source system process are performed, the amount of software processing increases considerably. Therefore, the number of automatic performance processes is reduced to one per four unit periods. In this example, part of the second automatic performance process is not completed before the start of the software effect process and software sound source system process. The remaining automatic performance process resumes after the software effect process and software sound source system process are performed once. Even if there is a delay in the automatic performance process, it can be completed often before the next interrupt because the automatic performance process can be performed during an idle time of CPU. Therefore, there is no practical problem in generating musical tone signals.

The invention is not limited only to the above embodiments. For example, not only personal computers and application software, but alto electronic musical instruments can be used for realizing automatic performance described above. The invention is also applicable to the case where a CPU can be graded up or different types of application software are used by the same apparatus. Similar automatic performance may be applied not only to electronic musical instruments but also to karaoke sing-along machines and game machines. In the above embodiment, the software effect process is allowed to be performed only when the software sound source system is selected. The software effect process may be performed by using the hardware sound source system.

The format of performance data may be a combination of an event and a relative time, a combination of an event and an absolute time, a combination of a pitch and a note length, or a direct record scheme (presence/absence of an event is recorded for each unit time duration).

In changing a tempo of the automatic performance, the period of tempo clocks may be changed, or the value of time data may be modified without changing the tempo clock. For example, if the period of tempo clocks is to be changed, the period is multiplied by two or five to count two or five per one process without counting one per one process. If the time data is to be modified, the time data value is multiplied by ½ or ⅕ if the period is multiplied by two or five.

In stead of activating the automatic performance process in response to a timer interrupt, a flag may be set in response to a timer interrupt. In this case, the flag is monitored during the automatic performance process executed by the main routine and the process is conducted in accordance with the state of the flag. Namely, the invention is not limited only to the case wherein the automatic performance process is activated directly in response to an interrupt.

The automatic performance process includes other automatic musical tone signal generating process such as an automatic accompaniment process.

The scheme of generating musical tone signal waveforms in the software sound source system may be a waveform memory scheme, an FM scheme, a physical model scheme, a harmonics synthesis scheme, a formant synthesis scheme, and the like.

The present invention has been described in connection with the preferred embodiments. The invention is not limited only to the above embodiments. It is apparent to those skilled in the art that various modifications, improvements, combinations and the like can be made without departing from the scope of the appended claims.

We claim:

1. An automatic performance data processing system for reading automatic performance data from storage means at a predetermined period and supplying the automatic performance data to a musical sound generating system, the automatic performance data including event data representative of the contents of each performance event and time data representative of a time when the performance event occurs, the automatic performance data processing system comprising:

a CPU for processing the automatic performance data;

means for judging operation-capacity of said CPU; and means for determining an execution period of processing the automatic performance data in accordance with the judged CPU operation-capacity.

2. An automatic performance data processing system according to claim 1, wherein the amount of reading the automatic performance data per one process is changed in accordance with the determined execution period.

3. An automatic performance data processing system for reading automatic performance data from storage means at a predetermined period and supplying the automatic performance data to a musical sound generating system, the automatic performance data including event data representative of the contents of each performance event and time data representative of a time when the performance event occurs, the automatic performance data processing system comprising:

a CPU for being capable of processing an automatic performance data processing process and another process in parallel;

designating means for designating an execution of the other process; and means for determining an execution period of processing the automatic performance data in accordance with whether the other process is executed or not.

4. An automatic performance data processing system according to claim 3, wherein the amount of reading the automatic performance data per one process is changed in accordance with the determined execution period.

5. An automatic performance data processing system according to claim 3, wherein said other process is at least one of a process of generating musical tone signal waveforms and a process of adding musical effects to the musical tone signal waveforms.

6. An automatic performance data processing system according to claim 3, further comprising means for judging operation-capacity of said CPU, wherein said execution period determining means determines the execution period of processing the automatic performance data also in accordance with the judged CPU operation-capacity.

7. An automatic performance data processing system according to claim 8, wherein said CPU processes the automatic performance data with a lower priority than the other process.

8. An automatic performance data processing system according to claim 5, further comprising means for judging operation-capacity of said CPU, wherein said execution period determining means determines the execution period of processing the automatic performance data also in accordance with the judged CPU operation-capacity.

9. An automatic performance data processing system according to claim 5, wherein said CPU processes the automatic performance data with a lower priority than the other process.

10. An automatic performance data processing method comprising the steps of:

judging operation-capacity of a CPU;

determining an execution period of processing automatic performance data in accordance with the judged CPU operation-capacity; and reading the automatic performance data from storage means at the execution period and supplying the automatic performance data to a musical sound generating system, under the control of the CPU, wherein the automatic performance data includes event data representative of the contents of each performance event and time data representative of a time when the performance event occurs.

11. An automatic performance data processing method according to claim 10, wherein said data reading step is a step of changing the amount of reading the automatic performance data per one process in accordance with the determined execution period.

12. An automatic performance data processing method comprising the steps of:

designating whether another process different from an automatic performance data processing process is executed;

determining an execution period of processing automatic performance data in accordance with whether the other process is executed or not; and reading the automatic performance data from storage means at the execution period and supplying the automatic performance data to a musical sound generating system, in parallel with the execution of the other process, wherein the automatic performance data includes event data representative of the contents of each performance event and time data representative of a time when the performance event occurs.

13. An automatic performance data processing method according to claim 12, wherein said data reading step is a step of changing the amount of reading the automatic performance data per one process in accordance with the determined execution period.

14. An automatic performance data processing method according to claim 12, wherein said other process is at least one of a process of generating musical tone signal waveforms and a process of adding musical effects to the musical tone signal waveforms.

15. An automatic performance data processing method according to claim 12, further comprising a step of judging operation-capacity of a CPU, wherein said execution period determining step determines the execution period of processing the automatic performance data also in accordance with the judged CPU operation-capacity, and said data reading step is executed by a CPU process.

16. An automatic performance data processing method according to claim 14, wherein said data reading step reads the automatic performance data from the storage means with a lower priority than the other process.

17. An automatic performance data processing method according to claim 14, further comprising a step of judging operation-capacity of a CPU, wherein said execution period determining step determines the execution period of processing the automatic performance data also in accordance with the judged CPU operation-capacity, and said data reading step is executed by a CPU process.

18. An automatic performance data processing method according to claim 14, wherein said data reading step reads the automatic performance data from the storage means with a lower priority than the other process.

19. A machine readable medium for use in a data processing system including a CPU, said medium containing program instructions executable by said CPU for causing the data processing system to perform the steps of:

judging an operation-capacity of the CPU;

determining an execution period of processing automatic performance data in accordance with the judged CPU operation-capacity; and reading the automatic performance data from storage means at the execution period and supplying the automatic performance data to a musical sound generating system, under the control of the CPU, wherein the automatic performance data includes event data representative of the contents of each performance event and time data representative of a time when the performance event occurs.

20. A machine readable medium according to claim 19, wherein said data reading step is a step of changing the amount of reading the automatic performance data per one process in accordance with the determined execution period.

21. A machine readable medium for use in a data processing system including a CPU, said medium containing program instructions executable by said CPU for causing the data processing system to perform the steps of:

designating whether another process different from an automatic performance data processing process is executed;

determining an execution period of processing automatic performance data in accordance with whether the other process is executed or not; and reading the automatic performance data from storage means at the execution period and supplying the automatic performance data to a musical sound generating system, in parallel with the execution of the other process, wherein the automatic performance data includes event data representative of the contents of each performance event and time data representative of a time when the performance event occurs.

22. A machine readable medium according to claim 21, wherein said data reading step is a step of changing the amount of reading the automatic performance data per one process in accordance with the determined execution period.

23. A machine readable medium according to claim 21, wherein said other process is at least one of a process of generating musical tone signal waveforms and a process of adding musical effects to the musical tone signal waveforms.

24. A machine readable medium according to claim 21, further comprising a step of judging operation-capacity of a CPU, wherein said execution period determining step determines the execution period of processing the automatic performance data also in accordance with the judged CPU operation-capacity, and said data reading step is executed by a CPU process.

25. A machine readable medium according to claim 21, wherein said data reading step reads the automatic performance data from the storage means with a lower priority than the other process.

26. A machine readable medium according to claim 23, wherein said method further comprises a step of judging operation-capacity of a CPU, and wherein said execution period determining step determines the execution period of processing the automatic performance data also in accordance with the judged CPU operation-capacity, and said data reading step is executed by a CPU process.

27. A machine readable medium according to claim 23, wherein said data reading step reads the automatic performance data from the storage means with a lower priority than the other process.

* * * * *